US006182881B1

(12) United States Patent
Kellner et al.

(10) Patent No.: US 6,182,881 B1
(45) **Date of Patent: *Feb. 6, 2001**

(54) STUD DRIVER AND SPRING THEREFOR

(75) Inventors: Gerd Kellner, Schramberg; Axel Ziegler, Lambsheim, both of (DE)

(73) Assignee: Adolf Wurth GmbH & Co. KG, Kuenzelsau (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/061,633

(22) Filed: Apr. 16, 1998

(51) Int. Cl.[7] ..... D25C 1/14

(52) U.S. Cl. ..... 227/10; 173/162.1; 173/211

(58) Field of Search ..... 227/9, 10, 130, 227/134; 173/210, 211, 162.1, 162.2; 267/141.1, 153

(56) References Cited

U.S. PATENT DOCUMENTS

| | | | | |
|---|---|---|---|---|
| 2,982,536 | * | 5/1961 | Kordes | 267/153 |
| 3,099,011 | * | 7/1963 | Wandel | 173/210 |
| 3,126,630 | | 3/1964 | Catlin et al. | 227/10 |
| 3,172,119 | * | 3/1965 | Siddons | 227/10 |
| 3,301,335 | | 1/1967 | Snelling | 173/162.1 |
| 3,331,546 | | 7/1967 | Brunelle | 227/10 |
| 3,341,101 | * | 9/1967 | Butler et al. | 227/10 |
| 3,490,673 | * | 1/1970 | Diehl | 227/10 |
| 3,632,032 | | 1/1972 | Termet | 227/10 |
| 3,895,752 | * | 7/1975 | Hatayama et al. | 227/10 |
| 3,969,989 | | 7/1976 | Maurer et al. | 227/130 |
| 4,332,340 | * | 6/1982 | Harris | 227/10 |
| 4,566,678 | * | 1/1986 | Anderson | 267/141.1 |
| 4,824,003 | | 4/1989 | Almeras et al. | 227/10 |
| 4,858,811 | * | 8/1989 | Brosius et al. | 227/10 |
| 5,868,384 | * | 2/1999 | Anderson | 267/141.1 |
| 5,901,894 | * | 5/1999 | Melocco | 227/10 |

FOREIGN PATENT DOCUMENTS

| | | |
|---|---|---|
| 1 939 801 | 5/1970 | (DE) . |
| 29 27 507 | 1/1981 | (DE) . |
| 195 09763 A1 | 9/1996 | (DE) . |
| 0 732 178 A1 | 3/1996 | (EP) . |

OTHER PUBLICATIONS

German search report in Appln. No. 196 38 341.2, dated Jan. 29, 1997.

European search report in Appln. No. 97115895.1–2306, dated Dec. 11, 1997.

* cited by examiner

*Primary Examiner*—Peter Vo
*Assistant Examiner*—Jim Calve
(74) *Attorney, Agent, or Firm*—Quarles & Brady LLP

(57) ABSTRACT

A stud driver for driving fastener studs in place with the aid of a propelling piston moved by a propellant contains a return spring concentrically surrounding a piston rod of the propelling piston. The return spring has roughly the shape of a relatively thin-walled cylindrical sleeve of elastomeric material reinforced at regular intervals by metallic ring disks. These metallic ring disks prevent any uncontrolled deformation of the elastomeric sleeve in high-speed movement of the propelling piston.

12 Claims, 1 Drawing Sheet

STUD DRIVER AND SPRING THEREFOR

TECHNICAL FIELD AND BACKGROUND OF THE INVENTION

The invention relates to a stud gun or stud driver by means of which fasteners, as a rule in the form of a nail or stud, can be driven into place. The stud driver contains a propelling piston driven by the propellant gas discharge on ignition of the cartridge, the forward movement of the piston driving the stud into place.

It is particularly in the case of automated operation of such a stud driver in which the fasteners to be driven into place are supplied by means of a crib incorporated in the driver that it is desirable to automatically return the propelling piston to its starting position.

A stud driver of this kind is already known (U.S. Pat. No. 3,331,546) in which for this purpose a plurality of disk springs is arranged about a piston rod of a propelling piston. These disk springs are preferably made of polyurethane and arranged alternatively reversed so that a pack of disk springs materializes, each of which is not connected to the other.

SUMMARY OF THE INVENTION

The invention is based on the object of defining a stud driver in which the propelling piston is returned after driving the fastener and in which the driver features a long useful life without the spring needing to be changed. The invention is also based on the object of defining a spring for such a stud driver.

To achieve this object the invention proposes a stud driver comprising a housing, a propelling piston arranged reciprocatingly in the housing, the propelling piston being propellable by a propellant and configured for driving a fastener into place, and including a spring of an elastic deformable material, more particularly an elastomeric material for returning the propelling piston to its starting position after driving action; the invention also proposing a spring comprising one or more of the features as set forth in the claims relating to the spring. Further aspects of the invention read from the sub-claims.

By arranging a spring which is tensioned against its spring force on driving the fastener in place it is now possible in a simple configuration of the driver for the propelling piston to be returned to its starting position after driving, i.e. a new fastener can be inserted directly after driving.

In another aspect of the invention it may be provided for that the propelling piston comprises a piston rod of reduced diameter which is surrounded over at least part of its length by a sleeve-shaped spring.

In assembling the driver the spring proposed by the invention is simply placed over the piston rod and the driver then assembled, i.e. there is now no need to take care to ensure that the individual disk springs are inserted alternatively reversed.

In yet another aspect of the invention it may be provided for that the spring extends between a driver part not involved in the movement of the propelling piston and the propelling piston, i.e. the spring directly engages the propelling piston.

Especially in still a further aspect of the invention it may be provided for that the spring engages a braking element acting together with the propelling piston, this meaning that towards the end of the driving movement of the propelling piston, i.e. when the spring is tensioned stronger, this movement is translated partly into a braking movement by the braking element.

The spring configured in this way may be, for example, a tension spring, it being, however, particularly of advantage when the spring is configured as a compression spring so that it is subject to pressure when driving the fastener into place.

In accordance with the invention a further aspect may provide for the spring comprising stiffening elements distributed over its length which themselves do not deform. The stiffening elements may be made partly of a harder and/or other material, as a result of which the deformation of the spring is confined to small portions between two reinforcing elements each so that the deviation of the spring from being roughly cylindrical also when subject to compression can be maintained small.

It is especially in yet a further aspect of the invention that it may be provided for that during the movement of the propelling piston the stiffening elements are guided by the latter and/or by the the travel of the piston, i.e. preventing the spring made of an elastomeric material from being deformed one-sidedly during the high-speed driving movement or becoming so twisted that the driving movement of the piston is obstructed or is even ruined thereby.

It may be especially provided for that the stiffening elements are metallic ring disks, the outer diameter of which roughly corresponds to the inner diameter of the piston travel so that they are guided at their outer side. Furthermore, their inner diameter may roughly correspond to the outer diameter of the piston rod so that they are also guided at their inner side, thus being preventing them from being tilted.

In accordance with the invention it may be provided for that the spring is vulcanized together with the reinforcing elements, as a result of which an integral spring materializes which can be produced as a single element featuring all desired properties.

In particular it may be provided for that the spring has a wall thickness which is maximally half as much, preferably maximally a third as much as the difference between the radius of the reinforcing elements and the radius of the internal opening in the reinforcing elements. As a result of this it is ensured that the spring in the compressed condition features a relatively small axial length, dictated substantially only by the thickness of all reinforcing elements thereby firmly in contact with each other to form a block.

In this arrangement the sleeve-like spring is arranged to advantage in the vicinity of the internal opening of the reinforcing elements and thus in the vicinity of the piston rod. Accordingly, its deformation is primarily radially outwards.

In the non-deformed condition the spring is preferably cylindrical in shape.

More particularly, the reinforcing elements may be arranged equidistant, this resulting, among other things, in there being no front and rear end of the spring, i.e. orientation of the spring now being uncritical in assembling the driver.

The reinforcing elements may be arranged to advantage so that their mutual spacing corresponds to roughly half their diameter.

BRIEF DESCRIPTION OF THE DRAWINGS

Further features, details and benefits read from the claims, the wording of which relates to the contents of description, the following description of a preferred embodiment of the invention as well as to the drawing in which:

DETAILED DESCRIPTION

Figure 1:
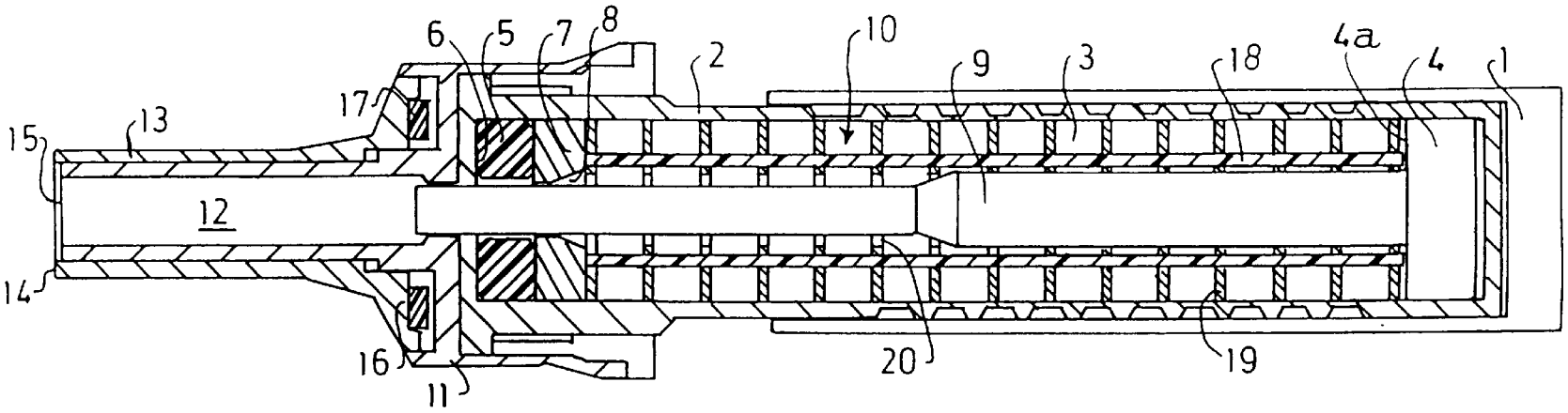
FIG. 1 is a schematic longitudinal section through the salient parts of a stud driver in accordance with the invention.

The simplified section as shown in FIG. 1 is a longitudinal section through a stud driver in accordance with the invention. The stud driver in accordance with the invention comprises a rear housing 1 in which among other things the means for supplying and firing a propellant are contained (these details not shown). In the housing 1 the piston barrel 2 is accommodated which at its inner side forms a cylindrical space 3. In the cylindrical space 3 a propelling piston 4 is accommodated which is sealed off from the space 3 with the aid of seals (not shown). The propelling piston 4 may be shifted in the cylindrical space 3, this shifting movement being caused by a propellant fired on the right-hand side of the propelling piston 4 as shown in FIG. 1.

In the forward, i.e. left-hand end of the cylindrical space 3, as shown in FIG. 1 a ring element 5 of an elastomeric material is accommodated which is in contact with a face end wall 6 of the barrel 2 and forms a braking buffer. On the side of the braking buffer 5 facing away from the face end wall 6 a shiftable brake cone 7 is located in the interior of the barrel 2. The brake cone 7 has a funnel-shaped internal opening 8 flared in the direction of the propelling piston 4.

At the front face surface area 4*a* of the propelling piston 4, i.e. on the side facing away from the propellant a piston rod 9 is applied to the propelling piston 4, this piston rod having in its first half directly connecting the propelling piston 4 a first diameter and in the adjoining portion thereto oriented towards the fastener a section diameter further reduced in size.

As a result of the above arrangement an annular space is formed between the piston rod 9 and the barrel 2, a return spring 10 being accommodated in this annular space. The return spring 10 is configured roughly sleeve-shaped and extends between the face surface area 4*a* of the propelling piston 4 comprising the piston rod 9 and the correspondingly opposite face end side of the braking element 7.

Mounted at the front end of the barrel 2 is an outer header shell 11 comprising a cylindrical inner space 12 for receiving the actual fastener. The bottom of the cylindrical inner space 12 comprises an opening through which the front end of the piston rod 9 protrudes.

Mounted on the header shell 11 axially shiftable is a mounting sleeve 13, the free face surface area 14 of which is configured annular and protrudes slightly beyond the face edge 15 of the header shell. The mounting sleeve 13 translates at its side facing the driver into a radial flange at the face end side of which an elastomeric buffer 17 is applied.

The return spring 10 has the shape of a cylindrical elongated sleeve 18 of an elastomeric material which is vulcanized with a plurality of reinforcing elements 19 through corresponding openings. The reinforcing elements 19 are arranged equispaced along the elastomeric material sleeve 18, they being located slightly spaced away from the inner wall of the cylindrical inner space 3. The reinforcing elements 19 comprise coaxially a central opening 20 in the form of a circular hole with which they form a row on the piston rod 9. The inner diameter of this hole 20 corresponds roughly to the outer diameter of the thicker portion of the piston rod 19.

The wall thickness of the elastomeric sleeve 18 roughly corresponding to a quarter to a third of the spacing between the outer circumference of the thicker portion of the piston rod 9 and the inner diameter of the cylindrical space 3 and the outer diameter of the propelling piston 4 respectively. The arrangement of the elastomeric sleeve 18 is selected so that it is arranged in the vicinity of the central middle opening 20 of the reinforcing elements 19.

FIG. 1 depicts the driver in the starting position in which the propelling piston 4 is shifted almost up to the rear end of the cylindrical space 3. In this position a fastener can be introduced into the inner space 12 of the header shell 11. The return spring 10 is in the released condition. When a propellant cartridge is then fired to drive a fastener the propelling piston 4 moves at high velocity from the depicted starting position into the driving position, i.e. to the left as shown in FIG. 1, resulting in the return spring being compressed. Since the reinforcing elements 19, made of metal, do not deform and, on the other hand, are guided by both the piston rod 9 and the wall of the cylindrical space 3 the sleeve 18 deforms only in the portion between the reinforcing elements 19 by the material being deformed primarily outwards. The spring 10 is thus shortened similar to the action of a concertina, the deformation of the elastomeric material sleeve 18 being distributed evenly over the length of the spring.

Towards the end of the driving action when the spring 10 is thus almost totally deformed and the individual reinforcing elements 19 are located practically in a single block, the remaining pulse is exerted as an axial force on the braking element 7 which compresses the braking buffer 5. This compression of the braking buffer 5 results in a reduction of its inner diameter and thus in a deceleration of the piston rod 9 up to standstill. The remaining thrust materializing thereby is then braked by the braking element 17. Once the fastener has been driven into place the spring 10 urges the propelling piston 4 back into its starting position as shown.

Figure 2:
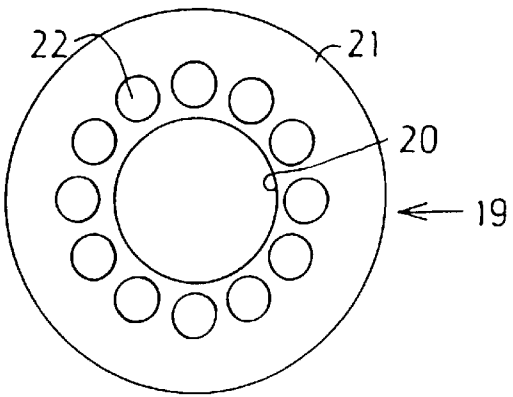
FIG. 2 is a face end view on a magnified scale of a reinforcing element configured as a ring disk for a spring of the arrangement as shown in FIG. 1.

FIG. 2 is a magnified view of a reinforcing element 19. The reinforcing element 19 has the shape of a metallic circular ring disk 21, for example, of aluminum. Provided concentric to the central opening 20 is a circle of smaller circular openings 22. These openings 22 correspond in their arrangement and their diameter to the arrangement and wall thickness of the elastomeric sleeve 18. It is through these holes 22 that the elastomeric sleeve 18 is formed, resulting in vulcanization with the metallic disks 21. This results in a spring configured as a single component which due to the reinforcing elements in the arrangement as shown in FIG. 1 is safeguarded from kinking outwards.

What is claimed is:

1. A stud driver comprising:

a housing;

a piston arranged for reciprocating movement in said housing, said piston being rapidly moved in a driving action by a propellant for driving a fastener into place, and said stud driver further comprising:

a spring of an elastic deformable material comprising a substantially cylindrical, axially elongated sleeve of an elastomeric material for returning the piston to a piston starting position after a driving action; and a piston rod of reduced diameter extending from said piston, wherein said piston rod is surrounded over at least part of its length by said sleeve of said spring, wherein said sleeve has an end proximate said piston and an opposite end further away from said piston; and a resilient braking structure axially disposed with respect to said sleeve outside of the opposite end of said sleeve and having an opening through which the piston rod moves, said sleeve of said spring changing length in an axial direction of the piston rod upon a driving action, and said spring providing a return movement for the piston upon completion of the driving action; and wherein the resilient braking structure comprises a moveable end wall through which the piston rod extends and a ring-shaped body of elastomeric material on an opposite side of said moveable end wall from said sleeve, said end wall having a central opening that reduces in diameter along said piston rod for cushioning an impact of the piston during a driving action.

2. The stud driver as set forth in claim 1, wherein said piston has a front face surface area and wherein said spring extends between said resilient braking structure and said front face surface area.

3. The stud driver as set forth in claim 1, wherein said spring is a compression spring.

4. The stud driver as set forth in claim 1, wherein said spring comprises non-deforming reinforcing elements distributed over a length of said sleeve.

5. The stud driver as set forth in claim 1, wherein said reinforcing elements are moved closer together during the movement of said piston in a driving action; and wherein said stud driver includes a barrel for limiting the movement of said reinforcing elements to the axial direction.

6. The stud driver as set forth in claim 4, wherein said reinforcing elements are metallic ring disks, said metallic ring disks having an inner diameter which is approximately the same as an outer diameter of said piston rod.

7. The stud driver as set forth in claim 6, wherein said reinforcing elements and said spring are vulcanized together.

8. The stud driver as set forth in claim 4, wherein said reinforcing elements are ring-shaped with an inner radius and an outer radius and wherein said sleeve has a wall thickness which is at most half as much as a difference between the outer radius of said reinforcing elements and the inner radius of the reinforcing elements which defines an internal opening.

9. The stud driver as set forth in claim 8, wherein said sleeve is disposed nearer to the internal opening of said reinforcing elements than to the outer radius of the reinforcing elements.

10. The stud driver as set forth in claim 9, wherein said sleeve is cylindrical when in a non-deformed condition.

11. The stud driver as set forth in claim 4, wherein each pair of adjacent reinforcing elements are spaced apart by a distance which corresponds to approximately half of an outer diameter of the reinforcing elements.

12. The stud driver as set forth in claim 1, wherein said reinforcing elements are spaced equidistant in a starting position along the axial direction of the piston rod.

* * * * *